United States Patent [19]

Matthews

[11] 4,269,589

[45] May 26, 1981

[54] SOLID STATE IGNITION CONTROL

[75] Inventor: Russell B. Matthews, Goshen, Ind.

[73] Assignee: Johnson Controls, Inc., Milwaukee, Wis.

[21] Appl. No.: 966,009

[22] Filed: Dec. 4, 1978

[51] Int. Cl.[3] ..... F23Q 9/14

[52] U.S. Cl. ..... 431/46; 431/24

[58] Field of Search ..... 431/24–26, 431/46, 52–54

[56] References Cited

U.S. PATENT DOCUMENTS

| | | | |
|---|---|---|---|
| 3,453,063 | 7/1969 | Lewis | 431/24 X |
| 3,610,790 | 10/1971 | Lindberg | 431/69 |
| 3,619,097 | 11/1971 | Clay | 431/80 |
| 3,902,839 | 9/1975 | Matthews | 431/46 |
| 3,947,220 | 3/1976 | Dietz | 431/80 |
| 4,178,149 | 12/1979 | Matthews | 431/46 |

*Primary Examiner*—Robert S. Ward, Jr.

*Attorney, Agent, or Firm*—Emrich, Root, Lee, Brown & Hill

[57] ABSTRACT

A control arrangement for a fuel ignition system having pilot and main valves in which the energization of the operate windings of the pilot and main valves, which are connected in series, is controlled by a silicon controlled rectifier. The SCR is enabled at the start of each ignition cycle by trigger pulses provided by a pulse generating circuit and when enabled, the SCR provides a shunt circuit path around the main valve winding permitting the pilot valve winding to be energized at its operating level effecting pilot valve operation and preventing the main valve from operating. When a pilot flame is provided, a capacitor of a flame sensing network is charged by flame rectified current, generating an inhibit signal for the pulse generating circuit which causes the SCR to be cut off, interrupting the shunt path to allow the main valve winding to be energized, effecting main valve operation. A trial for ignition timer diactivates the pilot valve and locks out the system if the pilot fuel fails to be lit before the end of a trial for ignition interval, the ignition timer being rendered ineffective in response to disabling of the SCR when a pilot flame is sensed. In one embodiment, the ignition timer comprises a time delay relay which is resettable by cycling the thermostat contacts open and closed. In another embodiment, the ignition timer comprises a thermal cutout switch mounted on the pilot valve and heated by the pilot valve operate winding.

40 Claims, 7 Drawing Figures

SOLID STATE IGNITION CONTROL

BACKGROUND OF THE INVENTION

1. Field of the Invention

This invention relates to fuel ignition systems, and more particularly to a control circuit for providing fail-safe operation of fuel valves of such systems.

2. Description of the Prior Art

In fuel ignition systems of the pilot ignition type, a pilot valve is operated at the start of an operating cycle to supply fuel to a pilot outlet for ignition to provide a pilot flame. When the pilot flame is established, a flame sensing circuit energizes a main valve to supply fuel to a main burner for ignition by the pilot flame typically, by operating a flame relay which closes contacts to connect power to the main solenoid.

Fail-safe control arrangements have been proposed in the prior art for preventing energization of the main valve for a fault condition of the flame sensing circuit which permits the flame relay to be operated in the absence of a pilot flame, or for a welded contact failure of the flame relay. These arrangements include a checking relay which when operated closes contacts which are connected in the energizing path for the main valve, such path being completed by contacts of the flame relay which is operated when a flame is sensed. The checking relay is energized over a path including normally closed contacts of the flame relay, and thus can be operated only if the flame relay is deenergized and its contacts are closed at the start of the operating cycle.

While fuel ignition control arrangements employing the checking relay function afford a high degree of fail-safe operation, the additional relay increases the cost of the control circuit. A further consideration is that the use of relays in the control circuit results in a larger package, making installation more difficult. That is, when the control circuit is used to control the fuel valves of a furnace in a heating system. The control circuit package, including the relays and the electronic control circuitry, is frequently mounted on the valve, and because of space limitations in the furnace vestibules, the control current package has to be disconnected from the valve while the valve is connected to the piping.

Although most known fuel ignition control circuits include relays, solid state ignition control circuits have been proposed previously. For example, in the U.S. Pat. No. 3,610,790 issued to A. W. Lindberg on Oct. 5, 1971, there is closed a solid state control circuit for a direct ignition system. The patented control circuit employs an SCR device which must assume conducting and then nonconducting states in effecting valve operation. At the start of an operating cycle, a pulse generating circuit provides trigger pulses for enabling the SCR device to conduct and energize the main valve solenoid connected in series with the SCR device. When the fuel is ignited and a flame is sensed, a flame sensing circuit inhibits the pulse generating circuit, terminating trigger pulse generation. In the absence of trigger pulses, the SCR device is rendered nonconducting, interrupting the energizing path for the main valve solenoid. The main valve solenoid is maintained energized over a holding path provided by a resistance which is shunted by the SCR device when it is conducting.

The flame responsive turnoff of the SCR device is achieved by leaking the charge off of a capacitor using the spark electrodes which are bridged by the main burner flame when the fuel is ignited. Thus, a resistance across the spark electrodes could also leak the charge off the capacitor an simulate a flame permitting the main valve to be operated in the absence of a flame.

SUMMARY OF THE INVENTION

The present invention provides a control arrangement for controlling the operation of pilot and main valves in a fuel ignition system, such as that for a furnace in a heating system. The operate windings of the pilot and main valve are connected in series and are energized under the control of a silicon controlled rectifier which is connected in parallel with the main valve winding. The SCR device is operated between conducting and nonconducting states by a control circuit comprised of a pulse generating circuit and a flame sensing network.

When thermostatically controlled contacts close in response to a request for heat, the pulse generating circuit provides trigger pulses which enable the silicon controlled rectifier to conduct providing a low impedance path to energize the pilot valve operate winding at its operating level allowing the pilot valve to operate and supply fuel to the pilot outlet for ignition by sparks provided by a spark generating circuit. When the SCR device is conducting, it provides a shunt circut path around the main valve operate winding to prevent the main valve from operating.

When the pilot fuel is ignited, a capacitor of the flame sensing network is charged by flame rectified current to provide the inhibit signal for the pulse generating circuit. This causes the SCR device to be cutoff, allowing the main valve winding to be energized to actuate the main valve to supply fuel to the main burner for ignition by the pilot flame. The spark generator has an associated flame responsive enabling circuit for enabling the spark generating circuit to generate ignition sparks whenever the thermostatically controlled contacts are closed and a pilot flame is not sensed. In another embodiment, the SCR device which controls the operation of the fuel valve solenoids also disables the spark generator when a pilot flame is sensed.

The SCR device must initially be operated from its nonconducting to its conducting state to energize the pilot valve solenoid and, when a flame is established, the SCR device must be operated from its conducting to its nonconducting state to permit energization of the main valve. The resistance of the main valve solenoid winding is selected to limit current to a level below the operate level for the pilot valve when the SCR device is nonconducting, and thus the pilot valve operation is conditioned upon conduction of the SCR device at the start of an ignition cycle.

In one embodiment, the pulse generating circuit and the flame sensing network are energized continuously and independently of the thermostat contacts which connect power to the valve windings. If the SCR device or any of the circuitry between it and the flame fails, the SCR device is maintained in one particular state and the system becomes inoperative. For example, if the SCR device fails to be operated to its conductive state at the start of an ignition cycle, the pilot valve cannot be operated. If on the other hand, the SCR device is maintained conducting, or for a short circuit failure of the SCR device, a shunt path is provided around the main valve winding and the main valve cannot operate.

In one embodiment, an electronic timer circuit controls the operation of the pilot valve and the SCR device to lock out the system and provide total shutoff of fuel should a pilot flame fail to be established before the end of a trial for ignition time defined by the timer. In another embodiment, a time delay switch defines the trial for ignition interval and locks out the system in the absence of a flame before the end of the interval. The time delay switch is resettable through operation of the thermostat which activates the system. This permits the time delay switch to be reset from a location remote from the furnace installation. In a further embodiment, a thermal time delay switch, which is mounted on the pilot valve and heated by its windings, defines the trial for ignition interval and should a flame fail to be established during such interval the thermal switch deactivates the pilot valve for a short interval of time, and then periodically reactivates and deactivates the pilot valve providing trial for ignition cycles until the pilot fuel is lit.

DESCRIPTION OF PREFERRED EMBODIMENTS

Figure 1:
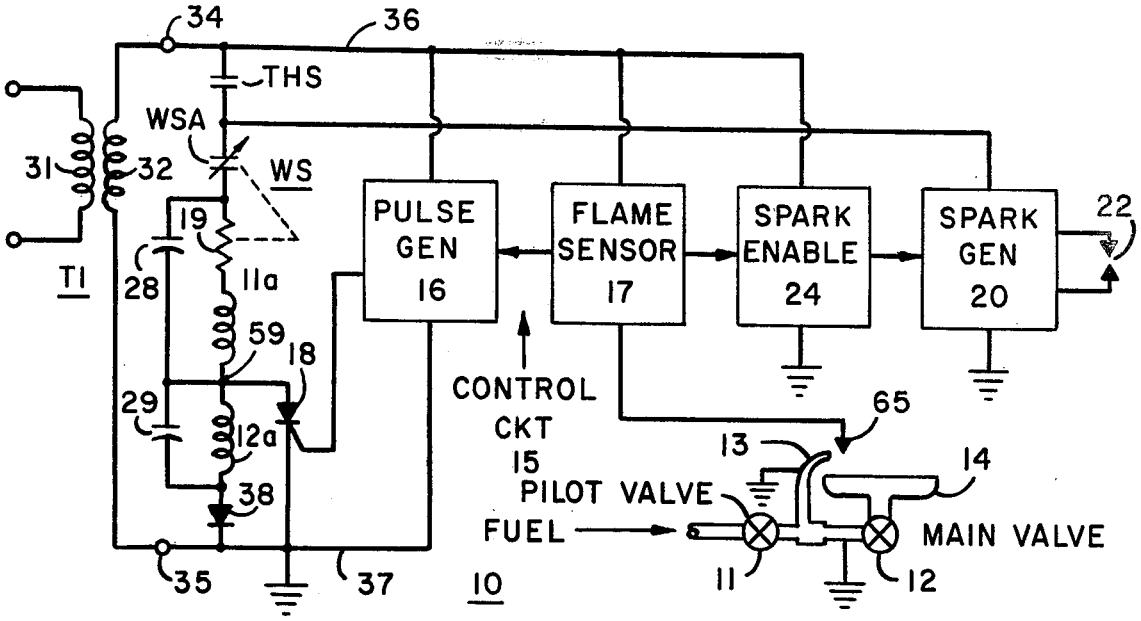
FIG. 1 is a schematic circuit and partial block diagram of a fuel ignition system including a control arrangement provided by the present invention.

Referring to FIG. 1 of the drawings, the fuel ignition system 10 provided by the present invention is described with reference to an application for controlling the operation of a pilot valve 11 and a main valve 12 in a heating system. The pilot valve 11 is actuated by a pilot valve solenoid 11*a* to supply fuel to a pilot outlet 13 for ignition by sparks provided by a spark generating circuit 20. The main valve 12 is actuated by a main valve solenoid 12*a* to supply fuel to a main burner 14 for ignition by the pilot flame. The pilot and main valves are connected in a redundant configuration with the pilot valve located at the fuel source outlet. Accordingly, fuel supplied to the main burner flows through both the pilot valve and the main valve so that fuel is supplied to the main burner only when both valves are operated.

The pilot valve solenoid 11*a* and the main valve solenoid 12*a*, which are connected in series, are energized under the control of a silicon controlled rectifier 18 which is connected in parallel with the main valve solenoid 12*a*. The SCR device 18 is operated between conducting and nonconducting states by a control circuit 15 comprised of a pulse generating circuit 16 and a flame sensing network 17. The pulse generating circuit 16 is continuously energized and provides trigger pulses to the gate of the SCR device 18.

In the absence of a request for heat, thermostatically controlled contacts THS are open, interrupting the anode circuit of the SCR device so that it is maintained nonconducting. When contacts THS close in response to a request for heat, the anode circuit for the SCR device is completed and the trigger pulses provided by the pulse generating circuit 16 enable the silicon controlled rectifier 18 to conduct. When the SCR device conducts, the pilot valve solenoid 11*a* is energized at its operating level and a shunt circuit path is provided around the main valve solenoid 12*a* to prevent the main valve from operating. The pilot valve operates to supply fuel to the pilot outlet 13 during a trial for ignition interval defined by a warp switch WS. The spark generating circuit 20 is also energized and provides sparks at spark electrodes 22, which are physically located adjacent to the pilot outlet 13, for igniting the pilot fuel.

When the pilot fuel is ignited, the flame sensing network 17 responds to the flame to provide an inhibit signal for the pulse generating circuit to cause the SCR device 18 to be rendered nonconducting to energize the main valve solenoid 12*a*. The SCR device 18 must initially be operated from its nonconducting to its conducting state to energize the pilot valve solenoid 11*a* and, when a flame is established, the SCR device 18 must be operated from its conducting to its nonconducting state to permit energization of the main valve.

Figure 2:
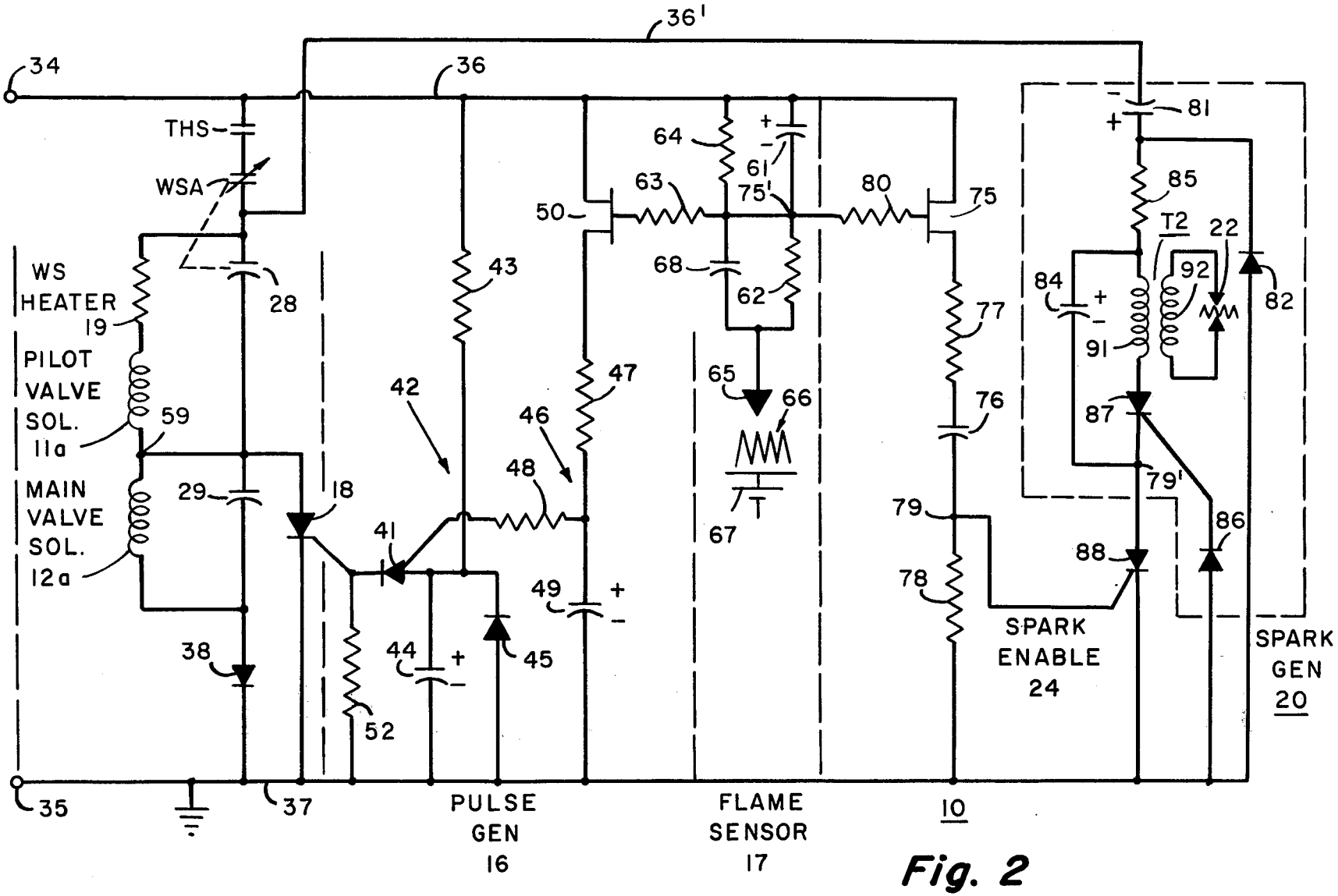
FIG. 2 is a schematic circuit diagram of the system shown in FIG. 1.

As will be shown, the flame sensing network 17 includes a capacitor 61, shown in FIG. 2, which is charged by flame rectified current to provide the inhibit signal whenever a flame impinges on a flame sensing electrode 65 located in the proximity of the pilot outlet 13. The inhibit signal controls an FET 50 of the pulse generating circuit to cause a capacitor 49 to charge up and disable a programmable unijunction transistor 41 thereby inhibiting the generation of trigger pulses for the SCR device 18. When the SCR device 18 is nonconducting, the main valve solenoid 12*a* is energized at its operating level to actuate the main valve to supply fuel to the main burner 14 for ignition by the pilot flame. The pilot valve solenoid 11*a* is maintained energized over a holding path including the main valve solenoid 12*a* when the SCR device 18 is rendered nonconducting.

The pilot valve solenoid 11*a* has a low resistance winding and the main valve solenoid 12*a* has a higher resistance winding. The resistance of the main valve solenoid winding is selected to limit current to a holding level for the pilot valve solenoid 11*a* when the SCR device 18 is nonconducting. The pilot valve solenoid 11*a* is energized at its operating level only when the SCR device 18 is conducting and provides a shunt path around the main valve solenoid.

The control circuit 15, including the pulse generating circuit 16 and the flame sensing network 17, is energized continuously and independently of the thermostat contacts THS which activate the valve solenoid circuit. If the SCR device 18 or any of the circuitry between it and the flame fails, the SCR device 18 is maintained in one particular state and the system becomes inoperative. For example, if the SCR device 18 fails to be operated to its conductive state at the start of an ignition cycle, the pilot valve cannot be operated. If on the other hand, the SCR device is maintained conducting, or for a short circuit failure of the SCR device 18, a shunt path is provided around the main valve solenoid 12*a* and the main valve cannot operate.

The warp switch WS effects deenergization of both the pilot valve solenoid 11*a* and the main valve solenoid 12*a* if a pilot flame fails to be sensed before the warp switch times out. The warp switch has its heating element 19 connected in series with the pilot and main valve solenoids. When the SCR device 18 is conducting, the level of the current flowing through the heating element is sufficient to cause the warp switch contacts WSA to open at the end of a heating time typically thirty seconds thereby deenergizing both valve solenoids. However, in normal operation, a pilot flame is established and the SCR device 18 is disabled before the warp switch time out. With the disabling of the SCR device, the main valve solenoid 12*a* is connected in series with the warp switch heater, limiting the warp switch heater current to a value less than the heating level.

The spark generating circuit 20 has an associated "flame responsive" enabling circuit 24 which permits the sparks generating circuit 20 to operate to generate sparks in the absence of a flame and which responds to the inhibit signal provided wherein a flame is sensed to disable the spark generating circuit 20. Thus, when the system is actuated and contacts THS are closed, the spark generating circuit 20 provides sparks whenever a flame is not established at the pilot outlet 13, and regardless of the state of the SCR device 18 which controls the operation of the fuel valves.

Considering the system 10 in more detail, power is supplied to the fuel ignition control system 10 over input transformer T1, shown in FIG. 1, which provides an AC voltage in the order of 24 VAC on conductors 36 and 37. As indicated above, the pulse generating circuit 16 and the flame sensing network 17, which comprise the control circuit 15, are connected between conductors 36 and 37 to be energized continuously and independently of the thermostatically controlled contacts THS. Accordingly, the pulse generating circuit 16 provides trigger pulses to the gate of the SCR device 18, but the SCR device 18 remains nonconducting whenever contacts THS are open.

The warp switch heater 19, the pilot valve solenoid 11*a* and the main valve solenoid 12*a* are connected in a series circuit path, including contacts WSA and THS and a diode 38, between conductors 36 and 37 which is energized only when contacts THS are closed. The SCR device 18 has its anode connected to the junction of solenoids 11*a* and 12*a* at point 59, and its cathode connected to conductor 37 so that the anode-cathode circuit of the SCR device 18 is connected in parallel with the winding 12*a* and diode 38.

The pilot valve solenoid 11*a* has a relatively low resistance, low turn, high current coil. In one embodiment, the pilot valve winding 11*a* comprised 910 turns of number 32 wire providing a resistance in the order of 12 ohms. The main valve solenoid 12*a* has a high resistance, high turn winding designed to allow the main valve to be operated with the resistance of the pilot valve winding in series. The main valve winding resistance is selected to permit the pilot valve winding to remain energized at the minimum operating current with the main valve winding in series. The main valve winding may comprise 2,054 turns of number 35 wire providing a resistance in the order of 90 ohms. The resistance of the warp switch heater is in the order of 18 ohms. It is pointed out that the warp switch function may be eliminated, with an 18 ohm, 5 watt resistor being substituted for the warp switch heater resistance to minimize heating of the pilot valve solenoid. The valve solenoids 11*a* and 12*a* are connected in a unidirectional circuit path with diode 38. The solenoids are energized during positive half cycles of the AC signal. Once operated, the valves are maintained operated during negative half cycles by capacitors 28 and 29 which charge up during the positive half cycles.

Referring to FIG. 2, the pulse generating circuit 16 includes a programmable unijunction transistor 41 having an anode control network 42, including a resistor 43 and a capacitor 44, and a gate control network 46, including resistors 47 and 48, a capacitor 49, and a field effect transistor 50. Resistor 43 and capacitor 44 are connected in series between conductors 36 and 37 permitting capacitor 44 to charge during positive half cycles of the AC signal when conductor 36 is positive relative to conductor 37. The charge on capacitor 44 establishes a control potential at the anode of the PUT device. A diode 45 bypasses capacitor 44 during negative half cycles of the AC signal.

Resistor 47 and capacitor 49 of the gate control network 46, are connected in series with the source-to-drain circuit of the FET device 50 between conductors 36 and 37. In the absence of a flame, the FET device 50 conducts bidirectionally enabling capacitor 49 to charge during each half cycle, establishing a potential which is coupled via resistor 48 to the gate of the PUT device 41. The time constant of resistor 47 and capacitor 49 is in the order of 15 milliseconds. Accordingly, capacitor 49 must charge for two to three cycles of the AC signal to become fully charged. Thus, in the absence of a flame, capacitor 49 does not accumulate a net charge.

The PUT device 41 is enabled whenever the anode potential exceeds the gate potential by +0.6 volts. When the PUT device 41 conducts, the capacitor 44 discharges over the anode-cathode circuit of the PUT device and a resistor 52, providing a trigger pulse to the gate electrode of the SCR device 18. The values of resistors 43 and 47 and capacitors 44 and 49 are selected so that as the capacitors 44 and 49 charge, the anode-to-gate potential of the PUT device exceeds the turnon value near the midpoint of each positive half cycle, and at a time when capacitor 44 has charged sufficiently to enable the SCR device 18 upon discharge of capacitor 44 over the PUT device. Since the SCR device 18 is cutoff during negative half cycles of the AC signal, the PUT device 41, which is pulsed into operation during each positive half cycle of the AC signal, retriggers the SCR device 18 each cycle until a flame is sensed.

When contacts THS close in response to a request for heat, the anode circuit of the SCR device 18 is completed to conductor 36 through the pilot valve solenoid 11*a*, the warp switch heater 19 and contacts WSA and THS. Accordingly, the SCR device 18 is enabled by the next trigger pulse. This permits current to flow from conductor 36 through contacts THS and WSA, the warp switch heater 19, solenoid 11*a* and the SCR device 18 to conductor 37. The pilot valve operates and supplies fuel to the pilot outlet 13.

The spark generating circuit 20 is also energized via conductors 36' and 37. The spark generating circuit 20 and its associated enabling circuit 24 are similar to those disclosed in my U.S. Pat. No. 4,178,149, which was issued on Dec. 11, 1979. The spark generating circuit 20 is of the capacitor discharge type and includes a capacitor 84 which is charged and then discharged over the primary winding 91 of an ignition transformer T2 during alternate half cycles of the AC line signal to provide sparks over spark electrodes 22 which are connected to the secondary winding 92 of the transformer T2.

The spark generating circuit includes a voltage doubler network including capacitor 84 and a further capacitor 81 which enables the capacitor 84 to be charged to approximately twice the AC line voltage. Capacitor 81 is connected in a unidirectional charging path with a diode 82 between conductor 37 and conductor 36', which is connected via contacts WSA and THS to conductor 36, to be charged during negative half cycles of the AC line signal. Capacitor 84 is connected in a series charging path which extends from conductor 36' over capacitor 81, a resistor 85, the capacitor 84 and a normally disabled silicon controlled rectifier 88 to conductor 37, permitting capacitor 84 to be charged during positive half cycles of the AC signal to twice the AC voltage applied to conductors 36 and 37 whenever the SCR device 88 is conducting. The SCR device 88 is enabled by the enabling circuit 24 during positive half cycles of the AC line signal whenever a flame is not impinging on the flame sensing electrode 65. The use of voltage doubling to charge the ignition capacitor 84 results in sufficient energy for spark generation for an applied AC voltage in the order of 24 VAC.

The primary winding 91 of the transformer T2 is connected in series with a further SCR device 87 in parallel with capacitor 84 to provide a discharge path for capacitor 84 over the primary winding whenever the SCR device 87 is conducting. The discharge current induces a voltage pulse in the secondary winding 92 of the transformer T2 which is applied to the spark electrodes causing a spark to appear in the gap between the electrodes.

The enabling circuit 24 includes a timing capacitor 76 which is connected in a series charging path with an FET device 75, the path extending from conductor 36 over the drainsource circuit of the FET device 75, and a resistor 77 to one side of the capacitor 76, and from the other side of the capacitor at point 79 over a resistor 78 to the conductor 37. The gate of the FET device 75 is connected over a resistor 80 to the junction of a capacitor 61 and resistor 62 of the flame sensing network 17.

In the absence of a flame, the FET device 75 conducts during both positive and negative half cycles of the AC line signal supplying a trigger signal to the SCR device 88 which causes the SCR device 88 to conduct, energizing the spark generating circuit 20 and permitting capacitor 84 to be charged and discharged over the ignition transformer to generate ignition sparks. When a flame impinges on the flame sensing electrode the FET device 75 is "pinched off" during negative half cycles of the AC line signal causing the SCR device 88 to be disabled thereby inhibiting the spark generating circuit 20 to terminate spark generation.

When the SCR device 18 is operated to energize the pilot valve solenoid, the warp switch heater 19 is also energized by current at its heating level. If the pilot fuel fails to be ignited before the warp switch times out, then contacts WSA open, interrupting the energizing path for the pilot and main valves solenoids. The contacts WSA are latched open and the circuit cannot be restarted until the warp switch is reset manually.

Under normal operating conditions, the pilot fuel is ignited before the warp switch times out, and the flame sensing network 17 disables the pulse generating circuit. The flame sensing network 17 includes capacitor 61 which is connected in a series charging path which extends from conductor 36 over the capacitor 61 and a resistor 62 to the flame sensing electrode 65. The sensing electrode 65 is positioned in the proximity of the pilot outlet (FIG. 1) is a spaced relation defining a gap 66 between the electrode and the outlet which is connected to system ground at point 67. The junction of resistor 62 and capacitor 61 at point 75' is connected over a resistor 63 to the gate electrode of the FET device 50. Resistor 64 is connected in parallel with capacitor 61 between conductor L1 and point 75' providing a bleeder path for the capacitor 61. Capacitor 68 reduces spark interference which would increase the minimum sensing voltage.

In the absence of a flame, the charging circuit for capacitor 61 is virtually an open circuit, preventing charging of the capacitor 61. However, when a flame bridges the gap 66, the resistance through the flame between the electrode 65 and the ground reference point 67 is in the order of 30 Megohms, permitting current to flow through the charging circuit. Due to rectification properties of the flame, current flows over the charging path only during positive half cycles from conductor 36 through capacitor 61 and resistor 62, to the sensing electrode 65, thence through the flame to ground. The rectified flame current charges capacitor 61 with the polarity indicated providing a DC voltage across the capacitor 61. The junction of capacitor 61 and resistor 62 is negative with respect to conductor 36, such potential being coupled via resistor 66 to the gate of the FET device 50 as an inhibit signal for the pulse generating circuit 16.

Whenever capacitor 61 is charged, then during positive half cycles of the AC line signal, capacitor 61 maintains the potential at the gate of the FET device 50 negative with respect to the potential at the source electrode of the FET device so that it is pinched off, or conducts unidirectionally. The unidirectional current causes capacitor 49 to charge up. Since the time constant of resistor 47 and capacitor 49 is approximately 15 milliseconds, then after two to three cycles, capacitor 49 is fully charged and the gate potential for the PUT device is increased to a value which disables the PUT device 41. That is, with capacitor 49 fully charged, the anode potential, which is provided as the result of the charging of capacitor 44, cannot exceed the gate potential by +0.6 volts.

When the PUT device 41 stops conducting, the SCR device 18 is no longer enabled. Accordingly, with the shunt path removed from the main valve solenoid, current flows through the main valve solenoid **12*a* and diode 38, energizing the solenoid to actuate the main valve to supply fuel to the main burner 14 for ignition by the pilot flame. Also, the current through the pilot valve solenoid 11*a* and the warp switch heater 19** is reduced to a holding level.

The FET device 75 of the spark generator enabling circuit is also pinched off. Accordingly, capacitor 76 accumulates a net charge, and after a few cycles, the flow of charging current ceases. Consequently, the SCR device 88 is no longer triggered into conduction so that the spark generating circuit 20 is disabled terminating further spark generation as long as a flame is sensed.

Following successful ignition, the pilot and main valves remain operated until the contacts THS open when the demand for heat has been met. Should a flameout occur following a successful ignition, capacitor 61 of the flame sensing network 17 is discharged permitting the FET device 50 to conduct bi-directionally and discharge capacitor 49. This decreases the potential at the gate of the PUT device 41 enabling the PUT device 41 to be rendered conducting under the control of its anode network 42, generating trigger pulses during each cycle of the AC signal. The SCR device 18 is reenabled by the pulses, deenergizing the main valve solenoid 12*a* and reenergizing the warp switch heater at its high current level to define a further trial of ignition interval. The spark generating enabling circuit 24 is also enabled since FET device 75 now conducts bidirectionally, and the spark generating circuit 20 provides sparks for igniting the pilot fuel.

If the flame is reestablished before the warp switch times out, then the flame sensing network 54 causes the PUT device 41 to be disabled rendering the SCR device 18 nonconducting to reenergize the main valve. Also, the spark generating enable circuit 24 disables the spark generating circuit 20. If the flame fails to be reestablished before the end of the new trial for ignition interval, the warp switch device times out and opens its contacts WSA to deenergize the fuel valves and lock out the system.

Should a fault occur such that the SCR device 18 is maintained disabled at the start of an ignition cycle, then when contacts THS close, the pilot valve cannot operate because the SCR device 18 is an effective open circuit. The current to the pilot valve solenoid is below the operating level when the pilot valve is energized through the main valve solenoid 12*a*. If, on the other hand, a circuit fault should occur that causes the SCR device 18 to conduct in the presence of a flame, the main valve winding 12*a* will remain effectively shorted via the SCR device 18 and the main valve will not operate.

SECOND EMBODIMENT

Figure 3:
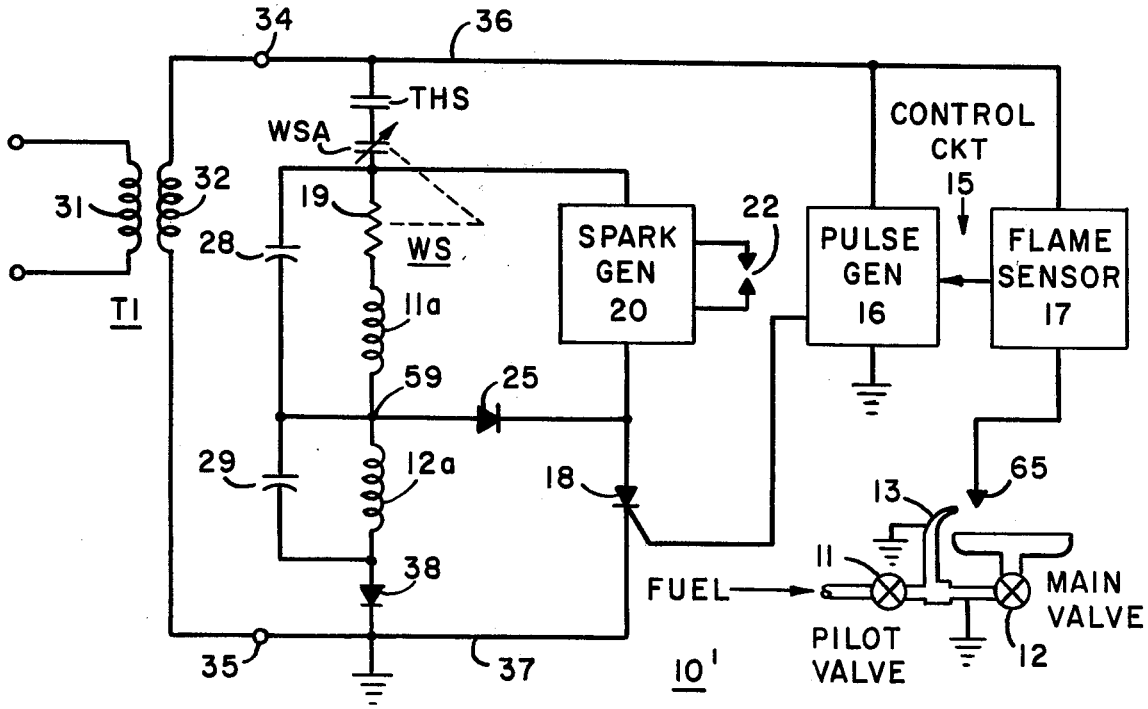
FIG. 3 is a schematic circuit and partial block diagram of a fuel ignition system including control arrangement provided in accordance with another embodiment of the invention.

Referring to FIG. 3 there is shown a schematic and partial block diagram of a second embodiment for fuel ignition control system 10' provided by the present invention. System 10' employs the control circuit 15 and the SCR device 18 which control the operation of the pilot valve 11 and the main valve 12 in the manner described above for system 10. The system 10' also includes the spark generating circuit 20, but in this system, the spark generating circuit 20 is enabled and disabled by the SCR device 18. Since the system 10' is generally similar to the system 10 shown in FIG. 1, like elements have been given the same reference numerals.

The spark generating circuit 20 is connected between the junction of the warp switch contacts WSA and the warp switch heater 19 and the anode of the SCR device 18 to be energized whenever contacts THS and WSA are closed and the SCR device 18 is conducting. The spark generating circuit 20 is deenergized whenever the SCR device is nonconducting. A diode 25 is connected between the junction of the valve solenoids 11*a* and 12*a* and the junction of the spark generating circuit 20 and the anode of the SCR device 18 to isolate the spark generating circuit from the valve control circuit.

In operation, the pulse generating circuit 16 and the flame sensing network 17 are energized continuously whenever power is supplied to conductors 36 and 37 over input transformer T1. When contacts THS close in response to a request for heat, pulses provided by the pulse generating circuit 16 enable the SCR device 18 in the manner described above for system 10. When the SCR device 18 conducts, the pilot valve solenoid 11*a* is energized to actuate the pilot valve to supply fuel to the pilot outlet, and the warp switch heater 19 is energized to define a trial for ignition interval. The spark generating circuit 20 is also energized and operates to generate sparks for igniting the pilot fuel.

When the pilot fuel is ignited, providing a pilot flame, the flame sensing network 17 inhibits the pulse generating circuit to cause the SCR device 18 to become nonconducting in the manner described above. When the SCR device is cutoff, the main valve solenoid is energized to actuate the main valve to supply fuel to the main burner for ignition by the pilot flame. The pilot valve solenoid and the warp switch heater 19 are maintained energized at holding levels over a path including the main valve solenoid. The spark generating circuit 20 is also disabled when the SCR device 18 is cutoff so that spark generation is terminated.

Should a flameout occur following a successful ignition, then the pulse generating circuit 16 causes the SCR device to conduct, providing a shunt path around the main valve solenoid 12*a* to close the main valve. Also, the spark generating circuit is enabled to provide sparks for reliting the pilot fuel, and the warp switch heater is again energized at its heating level to define a new trial for ignition interval. If a flame is sensed before the warp switch times out, the SCR device 18 is disabled as described above. If, on the other hand, the warp switch times out, then its contacts WSA open to deenergize the valve solenoids shutting off all fuel to the burner apparatus.

TRIAL FOR IGNITION TIMER

Figure 4:
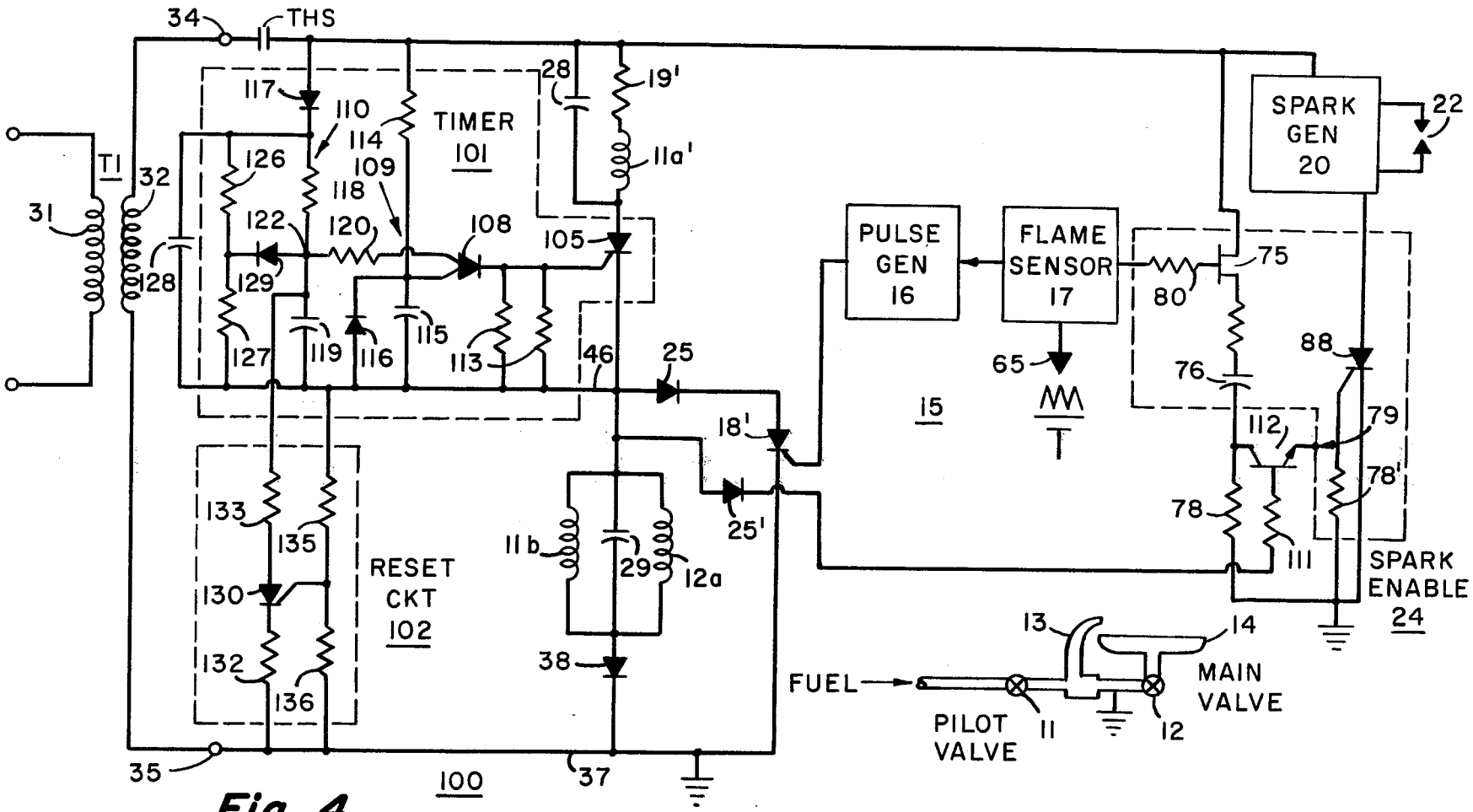
FIG. 4 is a schematic circuit and partial block diagram of a fuel ignition control system which is similar to that shown in FIG. 1 and which includes an electronic trial for ignition timer circuit.

Referring to FIG. 4, a further embodiment of a fuel ignition control system 100 provided by the present invention includes a trial for ignition timer circuit 101 which responds to the closing of thermostatically controlled contacts THS to effect the energization of the pilot valve 11 during a trial for ignition interval defined by the timer circuit 101. Should a pilot flame fail to be established before the end of the trial for ignition interval, the timer circuit 101 effects deenergization of the pilot valve, thereby providing 100% shutoff of fuel for such condition.

The system 100 comprises a pulse generating circuit 16, a flame sensing circuit 17, a spark generating circuit 20 and a spark enabling circuit 24, shown in block diagram form in FIG. 4, which are the same as those illustrated in FIG. 2 for the control system 10. In system 100, the thermostatically controlled contacts THS are connected in series with one of the conductors 36 which supplies AC power to the circuit. Thus, the control system 100 is deactivated whenever the contacts THS are open. When contacts THS close to activate the system, the timer circuit 101 provides an inherent delay, in the order of five seconds, prior to energizing the pilot valve at startup, permitting any fault to manifest itself and cause the system to go to lockout.

In the system 100, the pilot valve 11 has a pickup or operate winding 11*a'*, which is connected in series with a current limiting resistor 19', the main valve winding 12*a*, and a hold winding 11*b*, which is connected in parallel with the main valve winding.

The operating sequence for system 100 is similar to that described above for system 10, with the SCR device being enabled under the control of the pulse generating circuit 16 to provide a shunt path around the main valve operate winding and the pilot valve hold winding during trial for ignition. The resistance of the parallel-connected main valve and pilot valve hold windings is large enough to prevent the pilot valve from pulling in when the SCR device 18 is nonconducting. After the pilot valve is operated, it is maintained operated by its hold winding which is energized when the SCR device 18 is cutoff when a pilot flame is sensed.

When the timer circuit 101 is initially activated, an SCR device 105 of the timer circuit 101 is enabled during the trial for ignition interval permitting the pilot valve operate winding to be energized. In normal operation, a pilot flame becomes established before the timer circuit 101 times out, and the pulse generating circuit 16, under the control of the flame sensing circuit 17, disables the SCR device 18 to energize the main valve winding 12*a*, allowing the main valve to operate, and to energize the hold winding 11*b* for the pilot valve. A reset circuit 102 responds to the disabling of the SCR device 18, indicative of a pilot flame being sensed, to override the timing circuit 101 thereby maintaining the SCR device 105 conducting so that the valve windings are maintained energized. If pilot ignition fails to occur before the end of the trial for ignition interval, the timer circuit 101 times out and places the system in a lockout state in which the SCR device 105 is disabled, interrupting the energizing path for the pilot valve pickup winding (and the anode circuit of SCR device 18), shutting off the pilot valve fuel, as well as preventing the flow of fuel to the main burner since a redundant valve arrangement is employed.

The timer circuit 101 also controls a transistor 112 which effects turnoff of the spark generator 20 via the spark enabling circuit 24 whenever the control system goes to its lockout state.

Considering the timer circuit 101 in more detail, a PUT device 108 and associated timing networks 109 and 110 form a pulse generating circuit which provides pulses for enabling the SCR device 105. Timing network 109, which controls the anode potential for the PUT device 108, includes a resistor 114 and a capacitor 115 which are connected in a series between conductor 36 and a further conductor 46 which in turn is connected via resistors 135 and 136 and SCR device 18 to conductor 37 providing a charging path for the capacitor 115 which charges during positive half cycles of the AC signal applied to conductors 36 and 37. A diode 116 which is connected in parallel with capacitor 115 provides a bypass to prevent charging of the capacitor during negative half cycles of the AC signal.

Timing network 110, which controls the gate potential for the PUT device 108, includes a diode 117, a resistor 118 and a capacitor 119 which are connected in series between conductors 36 and 46, and through resistors 135 and 136 from conductor 46 to conductor 37. The junction of resistor 118 and capacitor 119 at point 122 is connected over a resistor 120 to the gate of the PUT device 108. A fast reset circuit, comprised of resistors 126 and 127, capacitor 128 and a diode 129, provides rapid discharge of the capacitor 119 following deactivation of the control system either through opening of thermostatically controlled contacts THS or following a momentary power interruption.

The values of the components of the timing networks 109 and 110 are selected such that during the trial for ignition interval, which is defined by the charging time of capacitor 119, the potential difference between the anode and gate of the PUT device 108 exceeds 0.6 volts, the turnon threshold for the PUT device 108, during each positive half cycle of the AC signal. As is described in the following operational description, this enables the PUT device to conduct. The cathode of the PUT device 108 is connected to the gate of the SCR device 105 and over redundant resistors 113 to conductor 46 so that when the PUT device 108 conducts, capacitor 115 discharges through the PUT device 108 into the gate of the SCR device 105, enabling the SCR device to conduct and energize the pilot valve operate winding 11*a*′ and to complete the anode circuit for SCR device 18. The PUT device 108 is enabled during each cycle of the AC signal during the trail for ignition interval and the pulses generated as capacitor 115 discharges, trigger the SCR device 108 on to maintain the pilot valve operate winding energized.

When a pilot flame is sensed, the reset circuit 102 controls the charging of capacitor 119 to prevent the timer circuit 101 from locking out the system. The reset circuit 102 comprises an SCR device 130 which is connected in series with resistors 132 and 133 between one side of capacitor 119 at point 122 and conductor 37. Resistors 135 and 136, which are connected between the other side of capacitor 119 at conductor 46 and conductor 37, provide a gate control network for the SCR device 130. The SCR device 130 is normally nonconducting and is prevented from conducting whenever SCR device 18 is conducting. However, when SCR device 18 is disabled by the pulse generating circuit 16 when a flame is sensed, the SCR device 130 of the reset circuit 102 conducts during positive half cycles of the AC signal, providing a discharge path for the capacitor 119 and preventing the capacitor from charging.

If ignition does not occur, then the potential provided at the gate of the PUT device 108 due to the charging of capacitor 119 exceeds the anode potential provided by the charging of capacitor 115, so that the PUT device 108 stops conducting and causes the SCR device 105 to be disabled and interrupt the energizing path for the pilot valve operate winding 11*a*.

The transistor 112, which disables the spark generating circuit 20 whenever the system goes to lockout, has its collector-emitter circuit connected between the output of the flame sensing network 17, at the junction of capacitor 76 and resistor 78, and the gate of the SCR device 88 which is connected over resistor 78′ to conductor 37. An enabling signal for transistor 112 is extended to the base of transistor 112 from conductor 46 through a diode 25′ and a resistor 111 whenever SCR device 105 is conducting. When enabled, transistor 112 extends gate signals to the SCR device 88 which controls the operation of the spark generating circuit 20 as described hereinbefore. The transistor 112 is cutoff thereby inhibiting the spark generating circuit whenever SCR device 105 is disabled as occurs, for example, when the timing circuit 101 times out. Under normal conditions, the SCR device 105 is maintained conducting as long as contacts THS remain closed, and turnon and turnoff of the spark generating circuit 20 is controlled by the "flame-responsive" spark enable circuit 24.

OPERATION

When contacts THS close, during positive half cycles, current flows from conductor 36 through diode 117, resistor 118, capacitor 119 and resistors 135 and 136, and SCR device 18, slowing charging the capacitor 119. Current also flows from conductor 36 through resistor 114, capacitor 115 to conductor 46 and through resistors 135 and 136 and SCR device 18 to conductor 37, charging capacitor 115. The time constant of the gate control network 110 is such that for an initial period, in the order of five seconds, the PUT device 108 is turned on early in the half cycle of the AC signal and at a time when capacitor 115 stores insufficient energy to trigger the SCR device 105 into conduction. However, capacitor 119 accumulates a charge in successive half cycles, and eventually the turn on time of the PUT device 108 is delayed, allowing capacitor 115 to charge longer. After the initial five second delay, the charge stored by capacitor 115 during a given half cycle is sufficient to trigger the SCR device 105 into conduction.

When the SCR device 105 is conducting, the anode circuit for the SCR device 18 is completed to conductor 36 through the pilot valve operate winding 11*a*'. In addition, when SCR device 105 conducts, the potential on conductor 46 approaches that of conductor 36, and through coupling diode 25' and resistor 111, an enabling signal is extended to the base of transistor 112 which conducts and enables the spark generating circuit.

The pulse generating circuit 16 is also enabled in response to the closing of contacts THS and it provides pulses for the SCR device 18. When the SCR device 105 conducts, the pulse generating circuit 16 operates under the control of the flame sensing circuit 17 in the manner described above with reference to the system 10 shown in FIG. 2. In the absence of a flame, timing capacitors 44 and 49 (FIG. 2) control the enabling of a PUT device 41 which in turn enables the SCR device 18 to provide a shunt path around the main valve solenoid winding 12*a*. When SCR device 18 is conducting, the potential on conductor 46 is effectively two diode drops away from the potential on conductor 37.

When a flame is sensed at the pilot outlet, the FET device 50 causes capacitor 49 to charge up and inhibit the PUT device 41 effecting disabling of the SCR device 18. Also, FET device 75 causes capacitor 76 to charge up and inhibit SCR device 88 to terminate spark generation. When the SCR device 18 becomes nonconducting, the shunt path is removed from the main valve winding 12*a* and current flows through the main valve winding 12*a*, operating the main valve. The pilot valve hold winding 11*b* is also energized to maintain the pilot valve operated. Also, when SCR device 18 becomes nonconducting, the potential on conductor 46 rises to nearly that of conductor 36, and current flow from conductor 46 through resistors 135 and 136 triggers the SCR device 130 on. When the SCR device 130 conducts, the timing capacitor 119 discharges preventing the timer circuit 101 from going to lockout.

Should a pilot flame fail to be established during the trial for ignition interval then capacitor 119 becomes charged to a value which maintains the PUT gate potential at a level above that provided by anode control network 109. This inhibits the PUT device 108 thereby causing the SCR device 105 to be cut off. When the SCR device 105 becomes nonconducting, the potential on conductor 46 decreases, approaching that of conductor 37, cutting off base current to transistor 112. Transistor 112 stops conducting and thus disables the spark generating circuit 20.

The system remains locked out, with capacitor 119 being maintained charged as long as contacts THS remain closed. When contacts THS open, capacitor 119 discharges over diode 129 and resistor 127. Diode 129 is normally maintained reverse biased as the result of charging of capacitor 128 upon activation of the system. When contacts THS open, capacitor 128 discharges through resistors 126 and 127 removing the reverse bias from diode 129 to permit capacitor 119 to discharge. This operation also ensues in the event of a momentary line interruption with contacts THS remaining closed so that capacitor 119 is discharged and the timer circuit 101 is prepared to reinitiate a trial for ignition when power is restored.

In summary, following activation of the system with the closing of contacts THS, the timer circuit 101 initiates a trial for ignition interval and enables SCR device 105 which permits energization of the pilot valve operate winding under the control of the pulse generating circuit 16. If a pilot flame is established before the end of the trial for ignition interval, reset circuit 102 overrides timing capacitor 119 to maintain the system operating. Also SCR device 18 is disabled permitting energization of the main valve winding to operate the main valve. The pilot valve is maintained operated over its hold winding 11*b*. If a flame fails to be sensed before the ignition timer 101 times out, the SCR device 105 is disabled interrupting the energizing path for the pilot valve solenoid, deenergizing the pilot valve and thereby preventing the supply of fuel to the main valve of the redundant valve construction. Also, transistor 112 is disabled to terminate spark generation. Under normal conditions, once the fuel valves have been energized, the spark generator is inhibited by the "flame responsive" spark enable circuit 24 and the timing capacitor 119 is controlled by reset circuit 102 to prevent the circuit from going to lockout. Contacts THS open at the end of the heating cycle, and capacitor 119 is discharged under the control of reset network 125 and the fuel valves are deenergized to shut off the supply of fuel to the burner apparatus.

Figure 5:
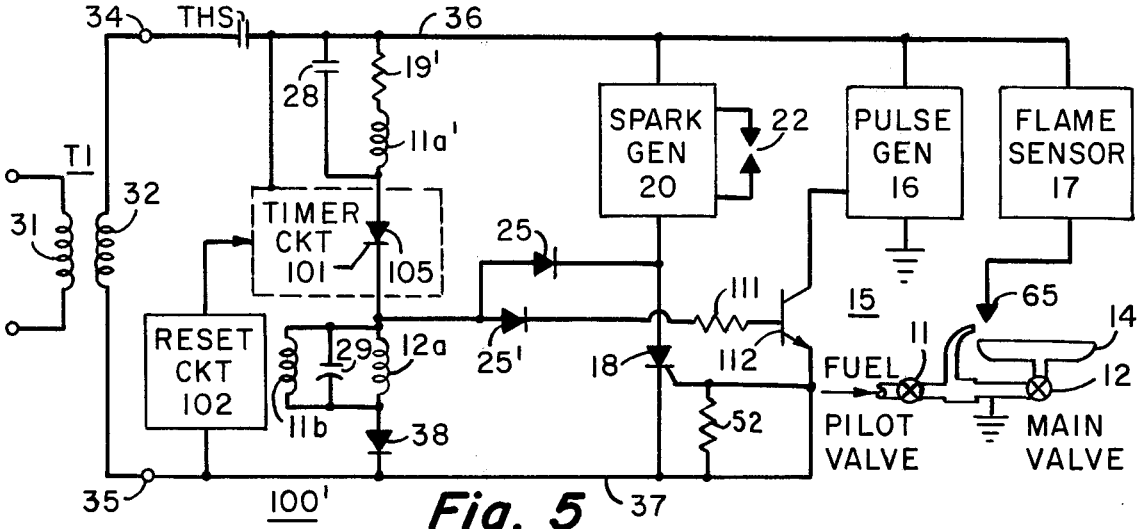
FIG. 5 is a schematic circuit and partial block diagram of a fuel ignition control system which is similar to that shown in FIG. 3, and which includes the timer circuit of the system shown in FIG. 4.

In the fuel ignition control system 100' shown in FIG. 5, the electronic timer circuit 101 is employed in a single channel control system similar to that shown in FIG. 3. In the system 100', the control transistor 112 responds to the timer circuit 101 to permit enabling of the SCR device 18 during the trial for ignition interval, allowing the pilot valve 11 and the spark generating circuit 20 to operate. If a pilot flame is sensed before the end of the trial for ignition interval, the flame sensing circuit 17 disables the pulse generating circuit 16 to effect disabling of the SCR device 18 as described herein above. If, on the other hand, a flame fails to be sensed before the end of the trial for ignition interval. The electronic timer circuit 101 causes SCR device 105 to stop conducting, and this causes transistor 112 to be disabled to interrupt the supply of enabling pulses to the SCR device 18.

The control transistor 112 has its collector-emitter circuit interposed between the output of the pulse generating circuit 16, at the cathode of the PUT device 41 (FIG. 2) and the gate of the SCR device 18. An enabling signal is extended to the base of transistor 112 through diode 25' and resistor 111 whenever SCR device 105 is conducting.

The detailed operation of the system 100' is apparent from the foregoing description of the single-channel system described above with reference to FIG. 3 and the description of the electronic timer circuit 101 described with reference to FIG. 4. Accordingly, a detailed description of the operation of system 100' is not presented.

Briefly when contacts THS close at the start of an ignition cycle, the electronic timer circuit 101 enables SCR device 105 during the trial for ignition interval defined by the charging time of capacitor 119. Also, the pulse generating circuit 16 is conditioned for generating pulses for enabling the SCR device 18, but the operation of the pulse generating circuit 16 is initially inhibited since the cathode circuit of the PUT device 41 is interrupted by transistor 112 which is nonconducting until the SCR device 105 conducts. After the initial delay provided by the timer circuit 101, the SCR device 105 conducts, raising the potential on conductor 46. This causes transistor 112 to conduct to complete the cathode circuit for the PUT device 41 permitting it to generate pulses for turning on SCR device 18.

The operating sequence continues as described above with the pilot valve being energized during the trial for ignition interval and the main valve being energized following disabling of SCR device 18 when a flame is sensed. If a flame fails to be sensed before the end of the trial for ignition interval, capacitor 119 becomes fully charged causing PUT device 108 to be inhibited so that SCR device 105 is disabled. With the disabling of SCR device 105, transistor 112 is also cutoff inhibiting the pulse generating circuit 16. The operation of the reset circuit 102 is as described above with reference to FIG. 4.

REMOTE RESET

Figure 6:
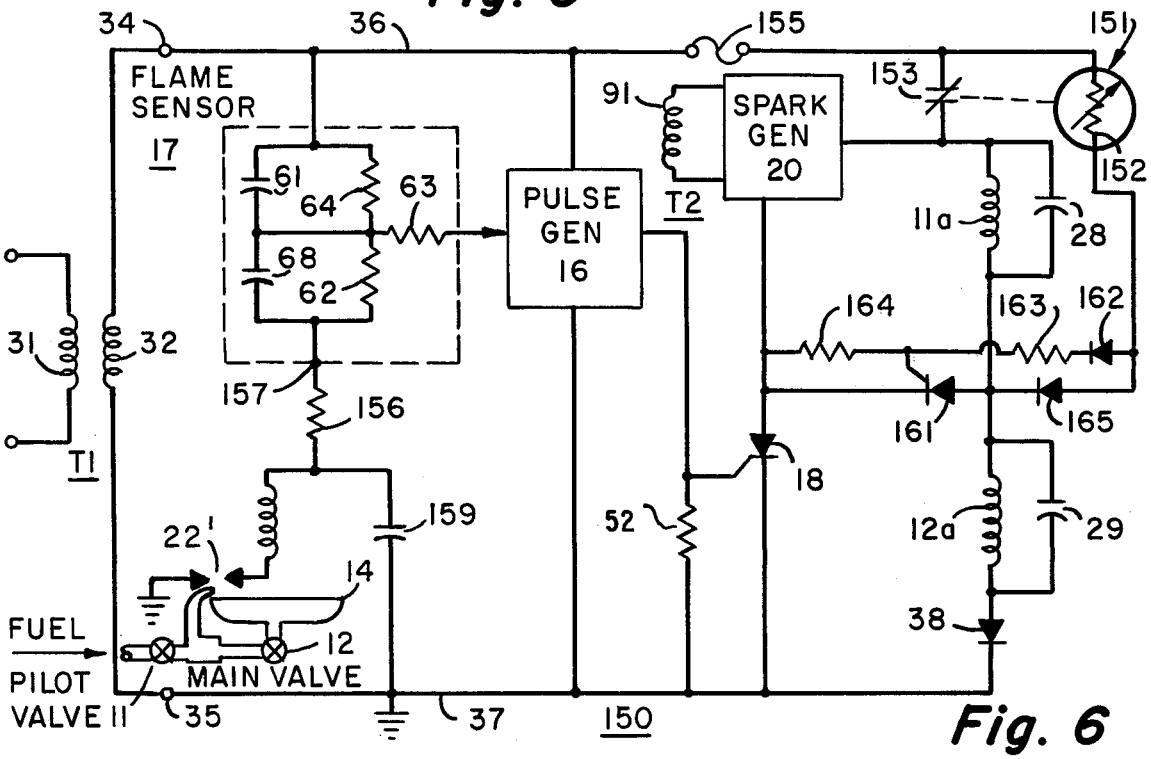
FIG. 6 is a schematic circuit and partial block diagram of a fuel ignition control system which includes a remote reset switch, which defines the trial for ignition interval.

The control system 150 shown in FIG. 6, is similar to system 10' shown in FIG. 3, but includes a time delay switch 151 which defines the trial for ignition interval and operates to place the system in a lockout state providing 100% shutoff of fuel supply, whenever a flame fails to be sensed before the end of the trial for ignition interval. The time delay switch 151 provides the function of a manually resetable warp switch of the system 10' but the time delay switch 151 is reset under the control of the thermostat switch which is generally located remote from the furnace installation and at a readily accessible location.

The pulse generating circuit 16, the flame sensing circuit 17 and the spark generating circuit 20 are similar to those employed in the system 10' shown in FIG. 3. However, this system employs flame sensing via the spark electrodes 22' of the spark generating circuit. More specifically, the secondary winding 92 of the ignition transformer T2 is connected in series with the spark electrodes 22' and a resistor 156 between the output of the flame sensing network at point 157 and conductor 37. A capacitor 159 provides a return path for the spark current generated as the result of the high voltage impressed across the spaced electrodes 22' while the spark generating circuit is operating.

When ignition takes place, flame rectified current flows from conductor 36 through resistors 64, 62 and 156, through winding 92 and the flame to grounded conductor 37 placing DC on the gate of the FET 50 which causes the capacitor 49 to charge up and disable the pulse generating circuit 16 as described herein above.

Considering the time delay switch 151 in more detail, the time delay switch may, for example, be a Klixon Time Delay Relay-600 Series, snap action, with automatic reset, commercially available from Texas Instruments. The switch 151 has a PTC thermistor-heater type element 152 which is connected in parallel with the pilot valve operate winding 112 and thus in series with the main valve winding 12*a*. When the SCR device 18 conducts at the start of an ignition cycle, the heater element 152 is energized at its heating level over the relatively low resistance path provided by the SCR device 18, and the heater element 152 begins to heat up. If the SCR device 18 is maintained conducting for a predetermined time, in the order of 30 seconds, the time delay switch operates to open its contacts 152 which are connected in series with the pilot valve winding energizing circuit, deenergizing the pilot valve winding 11*a* to cause the pilot valve to close. The heater element 152 is maintained energized over a path including the SCR device 18 as long as contacts THS are closed. The SCR device 18 continues to respond to the trigger pulse provided by the pulse generating circuit 16 since its anode circuit is completed through the heater element. The system remains locked out until contacts THS are opened and kept open long enough for the heater to cool down and permit contacts 152 to reclose.

A turnoff network 160 including an SCR 161, diode 162, resistors 163 and 164 and diode 165 provides a safety lockout to guard against inadvertant operation of the pilot valve under certain fault conditions, such as an open circuit failure of the heater element 152 during a lockout condition. Diode 162 and resistors 163 and 164 provide a trigger signal for the SCR device 161 to cause it to conduct whenever current is flowing through the heater element 152. The SCR device 161 is connected in circuit between pilot valve winding 11*a* and the SCR device 18 such that the pilot valve winding 11*a* can be energized at its operate level only if both SCR devices 161 and 18 are conducting. For an open circuit of the heater element 152, no gate signal is supplied to the SCR device 161 and it remains nonconducting. When either SCR device is non-conducting, the resistance of the main valve winding 12*a* limits the current flowing through the pilot valve winding to a holding value which is below the level required to initially operate the pilot valve, but which is sufficient to maintain the pilot valve operated. A short circuit condition for the heater element 152 will cause fuse 155 to blow and interrupt power to the system.

OPERATION

When contacts THS close, pulse generating circuit 16 operates as described above to provide enabling pulses for the SCR device 18. Also, current flows through the heater element 152, diode 162 and resistors 163 and 164 to the anode of the SCR device 18 which then responds to the pulses provided by the pulse generating circuit 16 and conducts to energize the pilot valve winding 11*a* at its operate level and to enable the spark generating circuit 20.

In normal operation, the pilot fuel is ignited prior to the timeout interval of the time delay switch 151, and the flame sensing circuit 17 controls the pulse generating circuit 16 as described above to disable the SCR device 18 causing the main valve 12 to operate and disabling the spark generating circuit 20. The heater element 152 is then maintained energized through the main valve solenoid winding 12a, the resistance of which is large enough to prevent heating of the heater element to its operate level.

Should a flame fail to be sensed before the delay switch 151 times out, then contacts 152 open, interrupting the energizing path for the pilot valve winding **11*a* to interrupt the supply of fuel to the pilot outlet. Although the main valve winding 12*a* is energized through the heater element 152, no fuel flows to the main burner because of the redundant arrangement of the pilot and main valves. As indicated above, the heater element 152 is a PTC type device and its resistance increases with heating of the heater element to reduce power dissipation while the system is in a lockout condition. The switch contacts 153 remain open until the heater element 152** is deenergized and cools down.

If a fault such as an open circuit condition for the SCR 18, occurs while the system is in lockout, the warp switch heater will cool down allowing the contacts WS to close. However, for such condition the pilot valve remains closed because the resistance of the main valve winding **12*a* limits the current through the pilot valve winding 11*a*, and the system remains locked out. If the heater element 152 should open circuit while the system is in lockout, with the result that the delay switch cools down and contacts WS reclose, the trigger signal is removed from the SCR device 161** since current flow through the heater element is interrupted so that the energizing path for the pilot valve winding is still interrupted.

THERMAL CUTOUT

Figure 7:
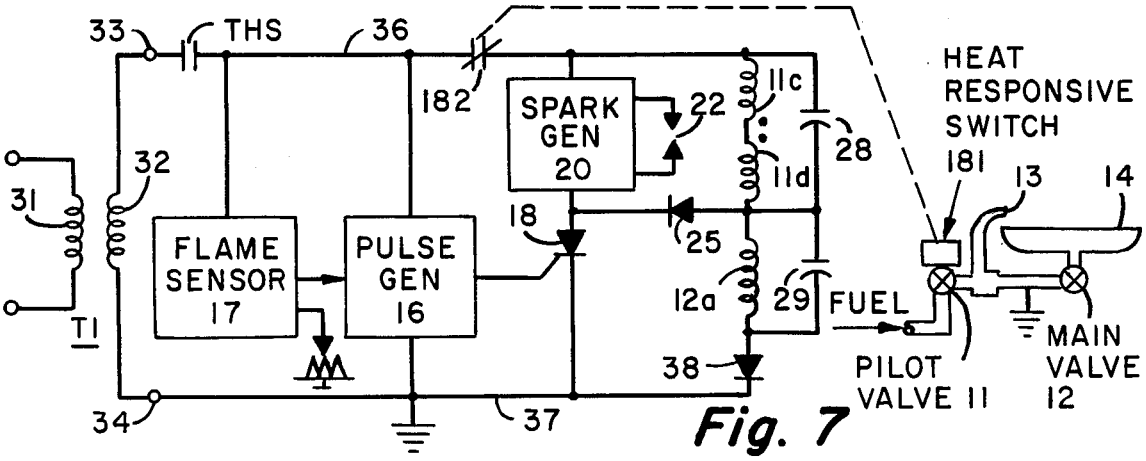
FIG. 7 is a schematic circuit and partial block diagram of a fuel ignition control system which includes a thermal cutout switch which defines the trial for ignition interval.

The system 180 shown in FIG. 7 includes a thermal cutout switch 181 which defines the trial for ignition interval. The thermal cutout switch 15 mounted on the pilot valve as shown in FIG. 7, and heated from the pilot valve solenoid windings, which comprise two valve coils **11*c* and 11*d* arranged in opposition to provide an effective voltage dropping resistance. This eliminates the necessity for an external high wattage resistor. In the system 180, the spark generator and pilot gas remain on for approximately four minutes after activation. Then the thermal switch 181 operates, responsive to heating of the pilot valve windings, and opens its contacts 182 to deenergize the pilot valve and the spark generator. After a cooling time, typically four minutes, the thermal switch 181 recloses its contacts 182** and a further trial for ignition ensues. This system is desirable for applications such as in gas dryers where it would be undesirable that the system go to lockout following failure to ignite during a single trial for ignition.

Considering the system 180 in more detail, the pulse generating circuit 16, the spark generating circuit 20 and the flame sensing network 17 are the same as those illustrated in FIG. 3. The pilot valve windings **11*c* and 11*d* and the main valve winding 12*a* are connected in series between conductors 36 and 37 with the thermal cutout switch contacts 182 being connected in series with conductor 36. Thus, whenever contacts 182 are open, the spark generating circuit 20 and the valve energizing circuit are deactivated. However, the flame sensing network 17 and the pulse generating circuit 16** remain activated.

The two pilot valve windings **11*c* and 11*d* are connected in opposition, and in one circuit which has constructed, one winding 11*c* comprised 725 turns of number 31 wire and the other coil comprised 400 turns of number 29 wire. The number of turns on the pilot valve is kept low to prevent the pilot valve from opening when the SCR device 18 is nonconducting. Conversely, the resistance of the main valve winding 12*a*** is large enough to prevent the pilot valve from being energized at the maximum circuit voltage while permitting the main valve to be energized at the minimum circuit voltage.

OPERATION

When contacts THS close, the pulse generating circuit 16 is operable to generate enabling pulses for the SCR device 18. Since the anode circuit for the SCR device 18 is completed through the pilot valve windings **11*c* and 11*d*, the SCR device 18 operates and provides a shunt path around the main valve winding 12*a*. The spark generating circuit 20 is also enabled when the SCR device 18 is conducting and operates to generate sparks for igniting the pilot fuel. When the pilot fuel is lit, the flame sensing network 17 responds to the pilot flame to control the pulse generating circuit 16 to terminate the generation of enabling pulses for the SCR device 18 which then becomes nonconducting. The current through the pilot valve windings 11*c* and 11*d* is then directed through the main valve winding 12*a* causing the main valve 12 to operate. The pilot valve is maintained operated by the current at a holding level which flows through the main valve winding 12*a* after the SCR device 18 is non-conducting. Also, the reduction of current through the pilot valve windings 11*c* and 11*d* as a result of connection of the main valve winding into circuit with the pilot valve windings prevents the heating of the windings to a level below that required to operate the thermal cutout switch 181**.

Should the pilot fuel fail to be lit during the trial for ignition interval, defined by the thermal cutout switch 181, which in this embodiment is in the order of four minutes, then the thermal cutout switch 181 operates to open its contacts 182 to deactivate the spark generating circuit 20 and to deenergize the pilot valve windings. After the pilot valve windings cool down, the thermal cutout switch 181 recloses its contacts 182, initiating a further ignition cycle.

Having thus disclosed in detail preferred embodiments of the invention, persons skilled in the art will be able to modify certain of the structure which has been disclosed and to substitute equivalent elements for those which have been illustrated; and it is, therefore, intended that all such modifications and substitutions be covered as they are embraced within the spirit and scope of the appended claims.

I claim:

1. In a fuel ignition system including a pilot valve operable to supply fuel to a pilot outlet, spark generating means for generating ignition sparks in the proximity of the pilot outlet for igniting the pilot fuel, and a main valve operable to supply fuel to a main burner for ignition by the pilot flame, a control arrangement comprising: circuit means connecting an operate winding of said pilot valve and an operate winding of said main valve in a series circuit path, activate means operable to connect power to said series circuit path; switching means for controlling the energization of said valve windings; and control means operable in the absence of a flame at said pilot outlet to enable said switching means to provide a shunt circuit path around said main valve operate winding to permit current to flow through said pilot valve operate winding at a level which is sufficient to actuate said pilot valve; said control means responding to a flame at said pilot outlet to disable said switching means whereby said shunt circuit path is interrupted and said main valve operate winding is energized to actuate said main valve, said pilot valve operate winding being maintained energized over said series circuit path including said main valve solenoid when said switching means is disabled, and current limiting means including said main valve operate winding for limiting the current flow through said series circuit path to a level which is insufficient to actuate the pilot valve when said switching means is disabled, whereby actuation of said pilot valve is conditioned upon the enabling of said switching means.

2. A system as set forth in claim 1 wherein said control means is energized continuously and independently of said activate means.

3. A system as set forth in claim 1 wherein said pilot valve operate winding means comprises a first section and a second section which is connected in series opposition with said first section in said series circuit path.

4. A system as set forth in claim 1 wherein said pilot valve further comprises a hold winding connected in parallel with said main valve operate winding, said pilot valve being operated in response to energization of its operate winding while said switching means is enabled, and said pilot valve being maintained operated in response to energization of its hold winding following disabling of said switching means when a flame is sensed.

5. A system as set forth in claim 1 wherein said circuit means includes ignition timer means operable to define a trial for ignition interval and to effect the disconnection of power from said series circuit path in the event said switching means fails to be disabled before the end of said trial for ignition interval.

6. A system as set forth in claim 5 wherein said ignition timer means comprises a controlled switching device connected in said series circuit path with said pilot valve operate winding and said main valve operate winding, and timing circuit means responsive to said activate means to generate a timing signal for enabling said controlled switching device during a trial for ignition interval defined by said timing circuit means and to terminate said timing signal, disabling said controlled switching device thereby interrupting the energizing path before said valve operate windings at the end of said trial for ignition interval.

7. A system as set forth in claim 5 wherein said ignition timer means comprises a switching device having normally closed contacts connected in circuit with said pilot valve operate winding, and operating means effective to open said contacts at the end of said trial for ignition interval whenever said switching means fails to be disabled before the end of said trial for ignition interval.

8. A system as set forth in claim 7 wherein said switching device comprises a thermal cutout switch including said contacts and said operating means, said operating means comprising a heat responsive control means mounted on said pilot valve and responsive heat radiated therefrom as the result of current flow through said pilot valve operate winding to cause said contacts to open when current at said level sufficient to actuate said pilot valve flows through said pilot valve operate winding for the duration of said trial for ignition interval.

9. A system as set forth in claim 8 wherein said operating means is effective to reclose said contacts following the interruption of current flow through said pilot valve operate winding for a given duration of time, to thereby initiate a further trial for ignition interval.

10. A system as set forth in claim 7 wherein said switching device comprises said contacts and a heater element connected in circuit with said activate means and responsive thereto to cause said contacts to open at the end of said trial for ignition interval, said switching means being effective to prevent said heater element from causing said contacts to open when said switching means is disabled before the end of said trial for ignition interval.

11. A system as set forth in claim 10 wherein said ignition timer means comprises circuit means responsive to current flow through said heater element to connect said pilot valve winding to said switching means and responsive to the interruption of current flow through said heater element to disconnect said pilot valve from said switching means thereby preventing energization of said pilot valve operate winding.

12. A system as set forth in claim 1 wherein said switching means comprises a controlled switching device operable between conducting and nonconducting states, said controlled switching device being connected in parallel with said main valve operate winding to provide said shunt circuit path whenever said controlled switching device is in its conducting state.

13. A system as set forth in claim 12 wherein said control means includes pulse generating means operable in the absence of a flame to generate enabling pulses for operating said controlled switching device to its conducting state, said controlled switching device responding to said enabling pulses only when said activate means operates to connect power to said series circuit path.

14. A system as set forth in claim 13 wherein said control means further comprises flame sensing means including sensing electrode means located in the proximity of said pilot outlet, a capacitor connected in a charging circuit path with said sensing electrode means to permit said capacitor to be charged to provide an inhibit signal whenever a flame impinges on said sensing electrode means, said pulse generating means responding to said inhibit signal to inhibit the generation of further enabling pulses thereby causing said controlled switching device to be operated to its nonconducting state.

15. A system as set forth in claim 13 wherein said control means further comprises flame sensing means including a capacitor connected in a charging circuit path with said spark electrode means to permit said capacitor to be charged to provide an inhibit signal whenever a flame impinges on said spark electrode means, said pulse generating means responding to said inhibit signal to prevent the generation of further enabling pulses thereby causing said controlled switching device to be operated to its nonconducting state.

16. A system as set forth in claim 12 wherein said spark generating means comprises a spark generating circuit and enabling means operable in the absence of a flame to enable said spark generating circuit to generate sparks in the proximity of said pilot outlet, said enabling means responding to said inhibit signal to disable said spark generating circuit thereby terminating spark generation when a flame is sensed at said pilot outlet.

17. A system as set forth in claim 12 wherein said controlled switching device is operable when conducting to enable said spark generating means, said spark generating means being disabled when controlled switching device is in its nonconducting state.

18. In a fuel ignition system including at least one fuel supply valve actuated by a valve solenoid to supply fuel to a fuel outlet for ignition to provide a flame, a control arrangement comprising: switching means for controlling the energization of said valve solenoid; control means including enabling means operable in the absence of a flame to enable said switching means to provide an energizing path for said valve solenoid for actuating said valve, and flame sensing means including sensing electrode means located in the proximity of said fuel outlet, a capacitor connected in a charging circuit path with said sensing electrode means to permit said capacitor to be charged to provide an inhibit signal when a flame impinges on said sensing electrode means, said enabling means responding to said inhibit signal to disable said switching means to thereby interrupt said energizing path for said valve solenoid, and holding circuit means providing a holding path for maintaining said valve operated after said switching means is disabled, said holding circuit means including current limiting means connected in series circuit with said valve solenoid for preventing actuation of said valve in response to current flow through said holding path whereby the actuation of said valve is conditioned on said switching means being enabled to provide said energizing path.

19. A system as set forth in claim 18 wherein said switching means is operable when enabled to provide a shunt circuit path around said current limiting means, said valve solenoid being energized over said shunt circuit path when said switching means is enabled.

20. A system as set forth in claim 19 wherein said fuel supply valve is operable to supply fuel to a pilot outlet for ignition to provide a pilot flame and wherein said current limiting means comprises the valve solenoid of a further fuel valve, said further fuel valve being actuated upon disabling of said switching means to supply fuel to a main burner for ignition by the pilot frame.

21. A system as set forth in claim 20 wherein said valve solenoids are connected in a series circuit, said holding circuit means further comprising activate means operable to connect power to said series circuit.

22. In a fuel ignition system including a pilot valve actuated by a pilot valve solenoid to supply fuel to a pilot outlet, a spark generator for generating ignition sparks in the proximity of the pilot outlet for igniting the pilot fuel, and a main valve actuated by a main valve solenoid to supply fuel to a main burner for ignition by the pilot flame, a control circuit comprising: control means including pulse generating means and flame sensing means; power circuit means connecting said control means to a source of potential for continuously energizing said control means, said pulse generating means being operable in the absence of a flame at said pilot outlet to generate pulses; switching means for controlling the energization of said pilot and main valve solenoids; circuit means connecting operate windings of said pilot and main valve solenoids in a series circuit path, activate means operable to enable said switching means to be enabled by said pulses and operate to provide a shunt circuit path around said main valve solenoid winding to permit current to flow through said pilot valve solenoid winding to actuate said pilot valve; said flame sensing means including means responsive to a flame at said pilot outlet to generate an inhibit signal, and means for coupling said inhibit signal to said pulse generating means to prevent said pulse generating means from generating further enabling pulses to cause said switching means to be disabled thereby interrupting said shunt circuit path and effecting energization of said main valve solenoid winding to actuate said main valve, said pilot valve solenoid being maintained energized over a circuit path including said main valve solenoid after said switching means is disabled, and current limiting means including said main valve operate winding for limiting the current flow through said series circuit path to a level which is insufficient to actuate the pilot valve when said switching means is disabled, whereby actuation of said pilot valve is conditioned upon the enabling of said switching means.

23. A system as set forth in claim 22 wherein said flame responsive means comprises sensing electrode means located in the proximity of said pilot outlet, a capacitor, and circuit means connecting said capacitor in a charging circuit path with said sensing electrode means to permit said capacitor to be charged to provide said inhibit signal whenever a flame impinges on said sensing electrode means.

24. A system as set forth in claim 22 wherein said pulse generating means comprises a controlled switching device having first and second control inputs and an output connected to a control input of said switching means, enabling circuit means connected to said first control input for providing an enabling signal at said first control input, reference circuit means connected to said second control input for providing a reference signal at said second control input, said switching means for a predetermined difference between said enabling and reference signals, said inhibit signal controlling said reference circuit means to prevent enabling of said switching device thereby terminating the generation of pulse outputs for said switching means.

25. A system as set forth in claim 24 wherein said reference circuit means comprises a capacitor and circuit means operable in the absence of said inhibit signal to permit said capacitor to periodically charge and discharge for providing said reference signal, said circuit means being responsive to said inhibit signal to cause said capacitor to be charged at said predetermined value as long as inhibit signal is provided.

26. A system as set forth in claim 25 wherein said enabling circuit means comprises a further capacitor and further circuit means for permitting said further capacitor to periodically charge to provide said enabling signal, said controlled switching device being enabled whenever the amplitude of said enabling signal exceeds the amplitude of said reference signal by a given amount, causing said further capacitor to discharge over said controlled switching device to provide said pulse output, said further circuit means limiting the charging of said further capacitor to a value less than said predetermined value thereby preventing enabling of said controlled switching device whenever said capacitor of said reference means is charged to said predetermined value.

27. In a fuel ignition system including a pilot valve operable to supply fuel to a pilot outlet, spark generating means for generating ignition sparks in the proximity of the pilot outlet for igniting the pilot fuel, and a main valve operable to supply fuel to a main burner for ignition by the pilot flame, a control arrangement comprising: circuit means including trial-for-ignition timing means connecting an operate winding of said pilot valve and an operate winding of said main valve in a series circuit path; activate means operable to connect power to said series circuit path; switching means connected to said series circuit path for controlling the energization of said valve windings; control means operable in the absence of a flame at said pilot outlet to enable said switching means to provide a shunt circuit path around said main valve operate winding to permit current to flow through said pilot valve winding at a level which is sufficient to actuate said pilot valve; said control means responding to a flame at said pilot outlet to disable said switching means whereby said shunt circuit path is interrupted and said main valve operate winding is energized to actuate said main valve, said pilot valve operate winding being maintained energized over said series circuit path including said main valve solenoid when said switching means is disabled, said ignition timing means being operable at the end of a time interval following the operation of said activate means to interrupt said series circuit path to thereby deenergize at least said pilot valve operate winding, said switching means being effective to prevent said ignition timing means from interrupting said series circuit path when a flame is established before the end of said time interval, and current limiting means including said main valve operate winding for limiting the current flow through said series circuit path to a level which is insufficient to actuate the pilot valve when said switching means is disabled, whereby actuation of said pilot valve is conditioned upon the enabling of said switching means.

28. A system as set forth in claim 27 wherein said ignition timing means comprises second switching means, which is connected to said series circuit path, enabling circuit means responsive to said activate means to enable said second switching means to permit energization of said pilot valve operate winding in response to the enabling of said first-mentioned switching means, said enabling circuit means defining a trial for ignition interval and being operable to disable said second switching means thereby deenergizing said pilot valve operate winding if a pilot flame fails to be established before the end of said trial for ignition interval, and reset means responsive to the disabling of said first switching means when a pilot flame is sensed to prevent said enabling circuit means from disabling said second switching means.

29. A system as set forth in claim 28 wherein said ignition timing means further comprises third switching means interposed between said control means and said first switching means and responsive to the enabling of said second switching means to couple said control means to said first switching means to enable said first switching means to respond to said control means during said trial for ignition interval, said third switching means being disabled, thereby decoupling said control means from said first switching means when said second switching means is disabled by said enabling circuit means.

30. A system as set forth in claim 28 wherein said ignition timing means further comprises third switching means responsive to the enabling of said second switching means to enable said spark generating means, said third switching means being responsive to the disabling of said second switching means to disable said spark generating means.

31. A system as set forth in claim 28 wherein said enabling circuit means comprises pulse generating means responsive to said activate means to generate enabling pulses for said second switching means, and timing network means including a capacitor and circuit means for permitting said capacitor to charge in response to operation of said activate means to define said trial for ignition interval, said pulse generating means being disabled, thereby disabling said second switching means, when said capacitor becomes charged to a given value, and said reset means being responsive to the disabling of said first switching means when a flame is sensed to prevent said capacitor from charging to said given value whereby said pulse generating means continues to provide enabling pulses for said second switching means.

32. A system as set forth in claim 27 wherein said ignition timing means comprises a controlled switching device connected in said series circuit path with said pilot valve operate winding and said main valve operate winding, and timing circuit means responsive to said activate means to generate a timing signal for enabling said controlled switching device during a trial for ignition interval defined by said timing circuit means and to terminate said timing signal, disabling said controlled switching device to thereby interrupt the energizing path for said valve operate windings at the end of said trial for ignition interval.

33. A system as set forth in claim 27 wherein said ignition timing means comprises a switch device having normally closed contacts connected in circuit with said pilot valve operate winding, and operating means effective to open said contacts at the end of said trial for ignition interval when said switching means fails to be disabled before the end of said trial for ignition interval.

34. A system as set forth in claim 33 wherein said switch device comprises said contacts and said operating means comprises a heater element connected in circuit with said activate means and responsive thereto to cause said contacts to open at the of said trial for ignition interval, said switching means being effective to prevent said heater element from causing said contacts to open when said switching means is disabled before the end of said trial for ignition interval.

35. A system as set forth in claim 34 wherein said ignition timing means further comprises circuit means responsive to current flow through said heater element to connect said pilot valve winding to said switching means and responsive to the interruption of current flow through said heater means to disconnect said pilot valve from said switching means thereby preventing energization of said pilot valve operate winding.

36. A system set forth in claim 33 wherein said switch device is operable to open said contacts to deenergize said pilot valve operate winding at the end of said trial for ignition interval when said switching means fails to be disabled before the end of said trial for ignition interval, said switch device being responsive to subsequent operation of said activate means to disconnect power from said series circuit path to permit said contacts to reclose for allowing a further trial for ignition following reconnection of power to said series circuit path.

37. In a fuel ignition system including a pilot valve operable when energized to supply fuel to a pilot outlet for ignition to provide a pilot flame, and a main valve operable when energized to supply fuel to a main burner for ignition by the pilot flame, a control arrangement comprising: activate switch means operable to effect the energization of said pilot valve causing said pilot valve to operate and supply fuel to said pilot outlet; ignition timing means for defining a trial for ignition interval during which said pilot valve remains energized, said ignition timing means being operable to deenergize said pilot valve to interrupt the supply of fuel to said pilot outlet if a pilot flame fails to be provided before the end of said trial for ignition interval and to reenergize said pilot valve after a time interval defined by said ignition timing means thereby initiating a further trial for ignition interval during which said pilot valve is reenergized to supply fuel to said pilot outlet; and control means operable when a pilot flame is provided during a trial for ignition interval for effecting energization of said main valve to cause said main valve to operate and supply fuel to said main burner and to prevent said ignition timing means from deenergizing said pilot valve.

38. A system as set forth in claim 37 wherein said ignition timing means comprises a switching device having normally closed contacts connected in an energizing path for an actuating solenoid means of said pilot valve and having heat responsive means mounted on said pilot valve and heated in response to heat radiated therefrom as a result of current flow through said pilot valve solenoid means to cause said contacts to open and interrupt current flow through said pilot valve solenoid means for said time interval whereby said heat responsive means is permitted to cool and reclose said contacts, thereby reenergizing said pilot valve solenoid means after an interval of time defined by the cooling time of said heat responsive means.

39. In a fuel ignition system including a pilot valve operable when energized to supply fuel to a pilot outlet for ignition to provide a flame, and a main valve operable when energized to supply fuel to a main burner for ignition by the pilot flame, a control arrangement comprising: activate switch means operable to connect power to the system to effect the energization of said pilot valve for operating said pilot valve; ignition timing means enabled by said activate means to define a trial for ignition interval, said ignition timing means being operable to deenergize said pilot valve if a flame fails to be provided before the end of said trial for ignition interval and to prevent reenergization of said pilot valve as long as said activate means connects power to the system, and said ignition timing means being disabled when said activate switch means is operated to disconnect power from the system whereby upon subsequent reoperation of said activate switch means to re-connect power to said system, said ignition timing means permits reenergization of said pilot valve during a further trial for ignition interval defined by said ignition timing means, and control means operable when a pilot flame is provided during a trial for ignition interval to effect the energization of said main valve for operating said main valve and to prevent said ignition timing means from deenergizing said pilot valve.

40. A system as set forth in claim 39 wherein said ignition timing means comprises a switching device having normally closed contacts connected in an energizing circuit for an operate winding of said pilot valve, and having operating means including a heater element connected in circuit with said activate switch means and responsive to current flow through said heater element following operation of said activate switch means to open said contacts at a given time after said activate switch means operates to connect power to the system, and, said heater element being permitted to cool as the result of interruption of current flow therethrough when said activate switch means operates to disconnect power from the system thereby permitting said contacts to reclose after a time interval determined by the cooling of said heater element whereby upon reoperation of said activate switch means to re-connect power to said system said energizing path for said pilot valve operate winding is completed permitting re-operation of said pilot valve.

* * * * *

UNITED STATES PATENT AND TRADEMARK OFFICE

CERTIFICATE OF CORRECTION

PATENT NO. : 4,269,589

DATED : May 26, 1981

INVENTOR(S) : Russell Byron Matthews

It is certified that error appears in the above—identified patent and that said Letters Patent is hereby corrected as shown below:

Column 19, line 20, cancel "means".

Column 19, line 48, "before" should be ---for---.

Column 19, line 62, before "heat" insert ---to---.

Column 21, line 4, after "when" insert ---said---.

Column 22, line 34, after "switching means" insert ---being enabled---.

Column 22, line 61, after "reference" insert ---circuit---.

Column 24, line 40, before "of" insert ---end---.

Signed and Sealed this

*Fifteenth* Day of *September 1981*

[SEAL]

*Attest:*

GERALD J. MOSSINGHOFF

*Attesting Officer*

*Commissioner of Patents and Trademarks*